United States Patent [19]

Boase et al.

[11] 4,191,465

[45] Mar. 4, 1980

[54] APPARATUS FOR PRODUCING SIMPLEX OF DUPLEX COPIES

[75] Inventors: Elmer E. Boase, Rochester; Alphonse B. DiFrancesco, Penfield; Stuart F. Ring, Rochester, all of N.Y.

[73] Assignee: Eastman Kodak Company, Rochester, N.Y.

[21] Appl. No.: 921,286

[22] Filed: Jul. 3, 1978

[51] Int. Cl.[2] ..... G03G 15/00

[52] U.S. Cl. ..... 355/3 SH; 271/9; 271/186; 355/24; 355/26

[58] Field of Search ..... 355/3 R, 3 BE, 14, 16, 355/24, 26, 3 TR, 3 SH; 271/9, 65, 186, DIG. 9

[56] References Cited

U.S. PATENT DOCUMENTS

| | | | |
|---|---|---|---|
| 3,687,539 | 8/1972 | Furuichi | 355/3 R X |
| 3,833,911 | 9/1974 | Caldwell et al. | 355/24 X |
| 4,095,979 | 6/1978 | DiFrancesco et al. | 355/26 X |

*Primary Examiner*—Fred L. Braun

*Attorney, Agent, or Firm*—William F. Noval

[57] ABSTRACT

Apparatus operable in duplex and simplex modes for making copies having images on one or both sides thereof. In the duplex mode, first and second transferable images are formed on a movable image transfer member by an image forming device, a copy sheet is supplied from a copy sheet supply into transfer relationship with the transfer member and the first image is transferred to a first side of a copy sheet at a first image transfer station. A vacuum drum located adjacent to the transfer member is rotated in a first direction to separate the copy sheet from the transfer member. After the copy sheet has been separated, the drum is rotated in a second opposite direction to invert the copy sheet while the first image is unfixed and to register the second side with the second transferable image on the transfer member at a second image transfer station. In the simplex mode, a first image is formed on the transfer member by the image forming device, a copy sheet is supplied from the supply into contact with the vacuum drum and the drum is rotated in the second direction to assist in registering the first side of the copy sheet with the first image on the transfer member at the second transfer station. Preferably an image fixing device is provided to fix the duplex or simplex images to the copy sheet. A control may also be provided to coordinate the operation of the apparatus in the simplex or duplex modes.

16 Claims, 8 Drawing Figures

APPARATUS FOR PRODUCING SIMPLEX OF DUPLEX COPIES

BACKGROUND OF THE INVENTION

1. Field of the Invention

This invention relates to apparatus for producing simplex or duplex copies. More particularly, this invention relates to apparatus for transferring unfixed transferable images to either one or both sides of a copy sheet before fixing of either image to the copy sheet.

2. Description of the Prior Art

Several techniques are known in the prior art for forming duplex images on a final copy medium such as a web or sheet. One such technique requires the use of two photoconductors upon which first and second transferable images are formed respectively. The copy medium is generally passed between the photoconductors and the first and second images are transferred to opposite sides of the copy medium. Another technique similar to the above but involving the use of only one photoconductor, utilizes an intermediate image storage member such as a drum, to receive the first image formed on the photoconductor before transfer to a final copy medium. These techniques suffer the disadvantages of increased cost, machine complexity and size and decreased reliability necessitated by the use either of two photoconductive and optical systems or of additional components before transfer to a final copy medium. Additionally there is the probability of degradation in image quality when an intermediate storage member is used. Furthermore, in some instances the developed images are tackified by use of solvent vapors which are potentially flammable and which require the use of a consumable fluid which must be replaced periodically.

A further duplexing technique utilized in certain commercial electrophotographic machines includes a single photoconductor wherein first fixed images developed sequentially on the first sides of a plurality of copy sheets by an electrophotographic process are collected in an intermediate tray. The copy sheets are then sequentially transported back through the electrophotographic process to develop second fixed images on the second sides of the copy sheets, thus producing duplex copies. The latter "two-pass" process has several disadvantages. Because the first sides of all the copy sheets are developed before development of the second sides of the copy sheets, a duplex copy is not available for inspection until all of the first sides of the copy sheets and one set of the second sides thereof have been developed. In addition, the relatively long paper paths required in passing a copy sheet through the entire electrophotographic process twice greatly increases the possibility of paper jams and other potential copy handling complications. Moreover, environmental conditions of image formation and the physical parameters of the copy sheet may change resulting in images of varying quality on opposite sides of a single sheet and misregistration between images on opposite sides of a copy sheet may also result.

Still aother duplex copying technique which may be considered especially relevant to the present invention involves fixing images to both sides of a copy sheet during a single pass through the disclosed electrophotographic processes. U.S. Pat. Nos. 3,506,347; 3,672,765; 3,869,202; and 3,947,270 disclose various embodiments of this technique. In the first patent just listed a first tackified image is formed on a transfer drum, the image is transferred to the first side of a copy sheet, and the sheet is inverted while the first tackified image dries and becomes fixed on the copy sheet. Thereafter, a second tackified copy image is formed on the transfer drum and the copy sheet is fed back into contact with the drum to transfer the second image to the second side of the copy sheet which is then transported to an output tray. In the latter three patents electrophotographic apparatus is disclosed for making copies wherein two images of an original are formed sequentially on a photoconductor, the images are developed and the first developed image is transferred to the first side of a copy sheet. The copy sheet is passed through a fuser to fuse or fix the first transferred image, is turned over and the opposite side of the copy sheet is brought into contact with the second developed image on the photoconductor. The second image is then transferred to the second side of the copy sheet, the copy sheet separated from the photoconductor and the second image fused by means of a second fuser. The disclosed techniques have several disadvantages. Since the first image is fixed before transfer of the second image, either two fusers must be used with attendant increase in cost, power and environmental heat or solvent fixing is used resulting in safety hazards and the inconvenience of handling consumable liquids.

SUMMARY OF THE INVENTION

The present invention alleviates the above and other disadvantages of prior duplex copiers. According to one feature of the invention a single copying process is provided resulting in decreased cost, size and complexity and increased reliability with no image degradation since no intermediate storage member is used. According to another feature of the invention unfixed images are formed on either one or both sides of a copy sheet before fixing of the images thus eliminating the need for a second fuser with attendant decrease in power usage, environmental heat and cost or for solvent fixing thus eliminating safety hazards and the inconvenience of replenishing liquids. Another feature of the invention reduces the length of the copy path from that required for "two-pass" duplexing thus reducing side to side copy quality variability and misregistration and the incidence of paper jams and increasing the production of a finished duplex copy.

In general, according to the present invention there is provided apparatus for producing simplex and duplex copies including a movable image transfer member; image forming means for forming transferable images on said transfer member; first and second image transfer stations located in image transfer relationship with said image transfer member; and vacuum drum means located adjacent to the image transfer member between the transfer stations. Preferably a supply for supplying copy sheets is also provided.

According to an aspect of the invention, when the apparatus is operated in the duplex mode, the image forming means forms first and second transferable images on the image transfer member and a copy sheet is supplied by the copy sheet supply into transfer relationship with the image transfer member at the first image transfer station in registration with said first image. The vacuum drum means is rotated in a first direction to separate by vacuum attraction the copy sheet from said transfer member after transfer of said first image to the first side of the copy sheet. The drum means is then rotated in a second opposite direction after said copy sheet has been separated from said transfer member to invert said copy sheet while said first image is unfixed so as to register the second side of said copy sheet with the second image on said transfer member at said second transfer station.

According to another aspect of the invention, when the apparatus is operated in the simplex mode, the image forming means forms a first transferable image on said image transfer member, said vacuum drum means is rotated in the second direction and said supply means supplies a copy sheet into contact with said vacuum drum means which assists in registering the first side of said copy sheet with the first image on said transfer member at said second transfer station.

According to another aspect of the invention, fixing means which preferably includes a pair of heated fuser rollers, is provided to fix the unfixed duplex or simplex images to the copy sheet.

A copy sheet diverter may also be provided between the vacuum drum means and the transfer member to remove the copy sheet from the drum and to guide it into transfer relation with the transfer member at the second transfer station in either the simplex or duplex mode.

The invention and its features and advantages will be set forth and become more apparent in the detailed description of the preferred embodiment presented below.

BRIEF DESCRIPTION OF THE DRAWINGS

In the detailed description of the preferred embodiment of the invention presented below reference is made to the accompanying drawings, in which.

DESCRIPTION OF THE PREFERRED EMBODIMENT

Figure 1:
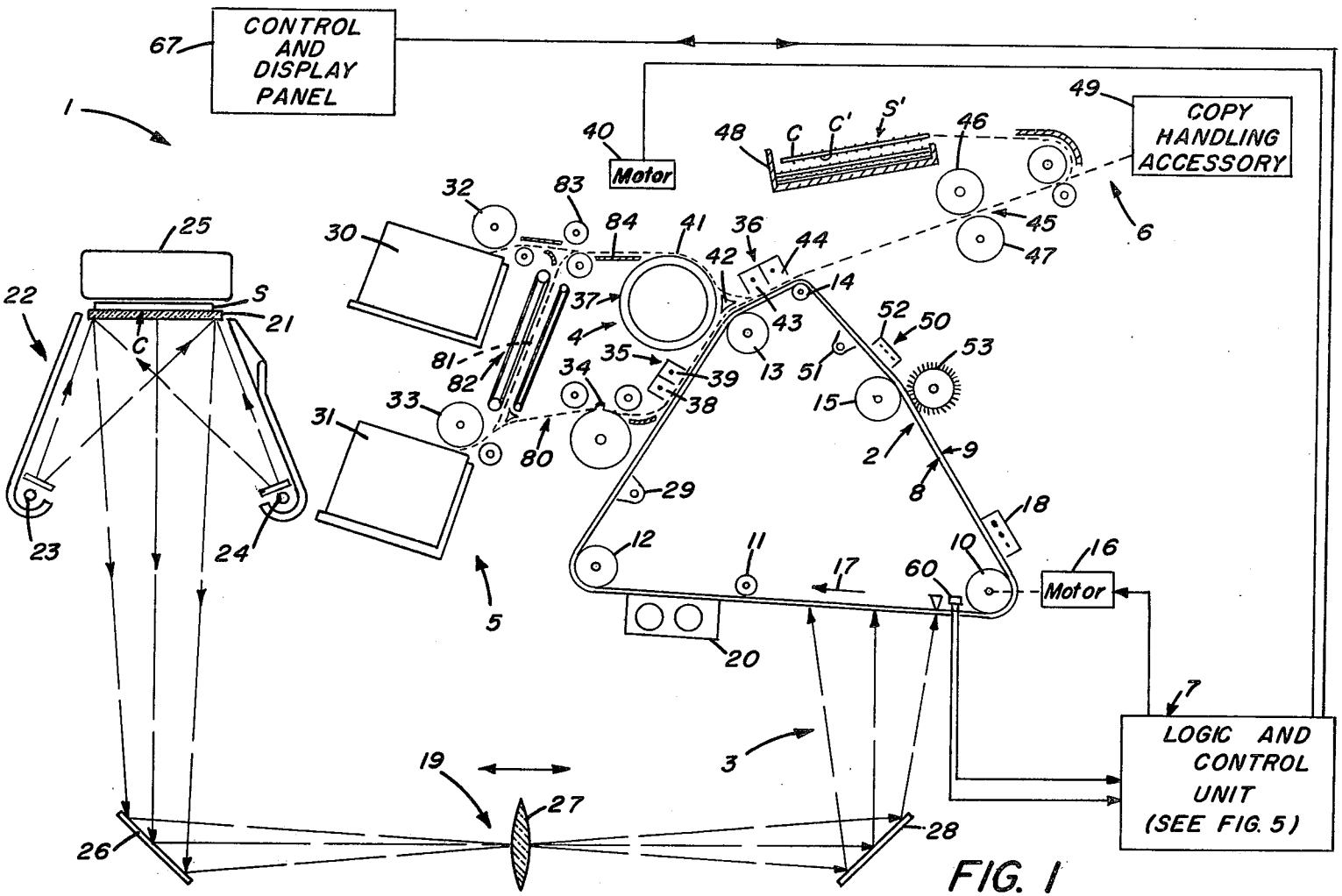
FIG. 1 is a schematic diagram of duplex/simplex apparatus incorporating a preferred embodiment of the present invention.

Referring now to the drawings, there is disclosed apparatus for producing duplex or simplex copies incorporating a preferred embodiment of the present invention. In FIG. 1 apparatus 1 is shown as an electrophotographic copier which may include, among other elements, an image transfer member 2, an image forming means 3, a copy sheet duplexing/simplexing section 4, copy sheet input and output sections 5 and 6, respectively, and a logic and control unit 7. Image forming means 3 forms transferable images on image transfer member 2, copy sheet input section 5 supplies copy sheets, copy sheet duplexing/simplexing section 4 transfers simplex or duplex images from transfer member 2 to a copy sheet, copy sheet output section 6 fixes the images to the copy sheet to produce a final copy and delivers the final copy to an output hopper or to a copy handling accessory and logic and control unit (LCU) 7 coordinates the operation of the various elements of apparatus 1 to produce final copies.

The term "sheet" as used in this application is used in reference to a single expanse of thin essentially flat material such as paper or transparencies having two opposed sides. "Simplex" refers to a sheet having only one side having an image; "duplex" refers to a sheet having images on both sides. A "copy sheet" is a sheet which receives simplex or duplex images. A "final copy" is a copy sheet having simplex or duplex images which are fixed to the copy sheet.

Image Transfer Member and Image Forming Means

Image transfer member 2 may be any member upon which transferable images may be formed and from which the images may be transferred to a copy sheet. In the preferred form of apparatus shown in FIG. 1, member 2 may incorporate a transparent support 8 and a photoconductor 9 backed by a conductive layer (not shown) grounded by grounding brushes 100 and may be trained about transport rollers 10, 11, 12, 13, 14 and 15. Roller 10 is coupled to a drive motor 16 controlled by LCU 7 to move member 2 in a clockwise direction indicated by arrow 17 past various electrophotographic work stations to be described laer in greater detail.

Image forming means 3 includes a charging station 18 at which the photoconductor 9 of member 2 receives a uniform electrostatic charge from a suitable device such as a corona charger; an exposing station 19 at which the image of an original to be copied is projected onto electrostatically charged photoconductor 9 of member 2 thereby dissipating the electrostatic charge at the exposed areas of member 2 to form a latent electrostatic image corresponding to the original image; and a developing station 20 at which developing power including toner particles having an electrostatic charge opposite to that of the latent electrostatic image is brushed over member 2 to develop the latent electrostatic image into a toner image corresponding to the original image.

Charging station 18 is shown as including a corona charger which may for example be a three-wire grid-controlled type which establishes a uniform negative surface potential on member 2. Other types of known charging devies may also be used such as open wire corona chargers or the like.

Exposing station 19 is shown as including a transparent exposure platen 21 upon which originals to be copies are positioned, an illumination source 22 including flash lamps 23 and 24, and projection optics such as mirrors 26 and 28 and lens 27 which may be movably mounted to permit reduced or enlarged image reproduction. A recirculating feeder 25 may be positioned on the top of platen 21 and may for example take the form of that disclosed in U.S. Pat. No. Re. 27,976 wherein a plurality of original documents having images only on first sides thereof are repeatedly fed in succession from a supply stack to the exposure platen 21 of copier 1. The feeder may also take the form of that disclosed in Research Disclosure Bulletin, Vol. 156, April, 1977, Item 15671 wherein original documents having images on both sides thereof are repeatedly fed in order to the exposure platen with alternate sides of each sheet being presented to platen 21.

In either case, feeder 25 places a selected side C of a sheet of an original document S with side C facing platen 21. When energized, flash lamps 23 and 24 illuminate side C of document S to produce a light image of the original image which is projected onto member 2 by mirrors 26, 28 and lens 27 to produce a latent electrostatic image corresponding to the original image.

Development station 20 may include a magnetic brush developer which brushes developer including toner particles having an electrostatic charge opposite to that of the latent electrostatic image over member 2. The toner particles adhere to the latent electrostatic image to form a transferable visible toner image which corresponds to the original image.

A post development erase station 29 including an infrared illumination source may be provided to reduce photoconductor fatigue i.e. electrical stress on the photoconductor which decreses its ability to accept or hold electrostatic charge.

Copy Sheet Input, Duplexing/Simplexing and Output Sections

Copy sheet input section 5 includes supplies 30 and 31 of copy sheets S' of any suitable material such as paper, transparencies or the like. Copy sheets S' are supplied from the top of either supply 30 or supply 31 by means of oscillating vacuum rollers 32, 33, respectively. When apparatus 1 is operating in the duplex mode, copy sheets S' are supplied from supply 31 along path 80 to registration mechanism 34 which registers the first side of copy sheet S' with the first toned image on member 2 at the first transfer station 35 and synchronizes the movement of copy sheets S' with member 2. When apparatus 1 is operating in the simplex mode copy sheets S' are supplied from supply 31 along path 81 by transport belts 82 to nip rollers 83 and thence over guide 84 to vacuum drum means 37 or from supply 30 to nip rollers 83 and thence to vacuum drum means 37.

When apparatus 1 is operating in the duplex mode, image forming means 3 forms first and second transferable toner images on member 2. Copy sheet duplexing-/simplexing section 4 is provided to effect transfer of the toner images to copy sheets and includes first and second image transfer stations 35 and 36 and vacuum drum meas 37 located adjacent to member 2 between transfer stations 35 and 36.

First transfer station 35 may include a first transfer corona charger 38 which has a negative DC potential applied to its corona wire and a first detack charger 39 which has an AC potential applied to its corona wire. Registration mechanism 34 registers a copy sheet S' with the first toner image formed on member 2 at first transfer station 35 where first transfer charger 38 impresses a negative charge on sheet S' to cause the positively charged first toner image to be transferred from member 2 to a first side C' of sheet S'. Detack charger 39 neutralizes the negative charge on copy sheet S' so that it can be easily separated from member 2.

Vacuum drum means 37 is rotatable in first and second opposite directions by means of motor 40. In the duplex mode, drum means 37 is rotated in a first direction to separate by vacuum attraction a copy sheet S' from member 2 after the first toner image has been transferred to a first side C' of copy sheet S' at transfer station 35 and to move the sheet along sheet turn around path 41. Drum means 37 is then rotated in a second direction after copy sheet S' has been separated from member 2, to invert sheet S' while the first toner image on side C' is unfixed and to assist in registering the second or opposite side C'' of copy sheet S' with the second toner image on member 2 at second transfer station 36. At station 36, the second image is transferred to side C'' of sheet S'. Copy sheet diverter 42 removes the copy sheet from drum means 37 and guides it into transfer relation with the second image on member 2 at second transfer station 36.

Second transfer station 36 is similar to first transfer station 35 and includes second transfer charger 43 and second detack charger 44. Second transfer charger 43 impresses a negative charge on a sheet S' to transfer a second toner image from member 2 to side C'' of sheet S' and second detack charger 44 neutralizes any charge remaining on sheet S' so that it may be easily separated from member 2.

After transfer of both toner images to sheet S' it is separated from member 2 and directed to output station 6 which includes a fixing means 45 for fixing the unfixed toner images to copy sheet S'. As shown, fixing means 45 may be a roller fuser including heated rollers 46 and 47 for heating and fusing the toner particles to sheet S' to form a final copy. Sheet S' may then be transported to an output tray 48 or to a copy handling accessory 49 such as the finisher disclosed in Research Disclosure Bulletin, Vol. 167, March, 1978, Item 16731, which effects straight or offset stacking and stapling of copy sheets or sets of copy sheets.

Copier 1 may be operated in a simplex mode wherein only first images are formed on member 2 and transferred to first sides of copy sheets S'. In such case, as described above, a copy sheet is supplied from either of supplies 30 or 31 to vacuum drum means 37 by nip rollers 83. Vacuum drum means 37 is rotated in the second (clockwise) direction to direct the first side of a copy sheet S' into registration with the first image on member 2 at second transfer station 36 where the first image is transferred to the copy sheet. Either rollers 83 or drum means 37 may be used to register copy sheet S' with the simplex image on web 2. Thereafter the image is fixed by fixing means 45 to produce a final copy which is transported to tray 48 or accessory 49.

A cleaning station 50 is provided to effect mechanical and electrical cleaning of photoconductor 9 of web 2. Station 50 includes a cleaning assist erase lamp 51 which exposes the photoconductor to radiation to reduce more of the charge remaining from the transfer and detack steps; a cleaning assist charger 52 which impresses an AC charge on photoconductive surface 9 of web 2 to neutralize the charges on untransferred toner particles; and a brush 53 which removes any residual toner from surface 9 and deposits it in a suitable collection container (not shown).

Vacuum Drum

Referring now to FIGS. 2, 3A-3D and 4 there is shown in greater detail vacuum drum means 37 and the operation of duplexing/simplexing station 4 when operating in the duplex and simplex modes. As shown, drum means 37 includes a cylindrical outer shell 54 and a cylindrical inner shell 55. Shell 54 has a plurality of holes 56 extending around the circumference and substantially the width thereof and is rotatable in first and second opposite directions by reversible motor 40. Shell 55 is stationary and is provided with a baffle 57 and an opening 58 which is adapted to communicate with holes 56 of shell 54 and with a source of vacuum 80 by means of conduit 81. Drum means 37 is located substantially adjacent member 2 in the region of roller 13 between transfer stations 35 and 36.

Figure 2:
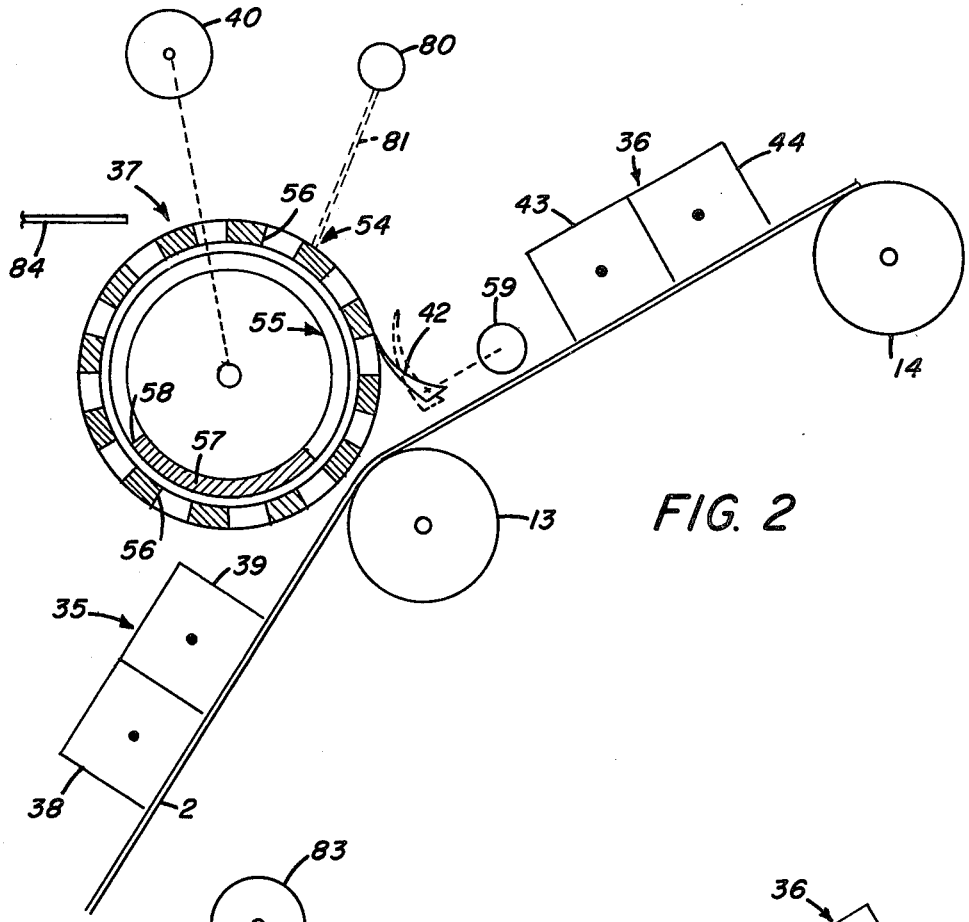
FIG. 2 is a diagrammatic sectional view of the copy duplexing/simplexing station of the copier of FIG. 1.

Sheet diverter 42 is mounted for movement between a first position as shown in solid lines in FIG. 2 where it is in contact with shell 54 of drum means 37 and a second position as shown in dotted lines where it is out of contact with shell 54. Diverter 42 may be moved between such first and second positions by any suitable means such as rotary solenoid 59.

Figure 3A:
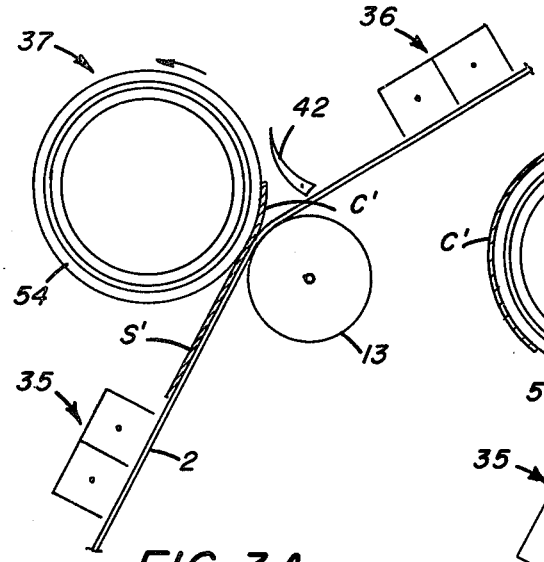
FIGS. 3A–3D are diagrammatic sectional views of the station of FIG. 2 showing different stages during copy sheet inversion in the duplex mode.
Figure 3B:
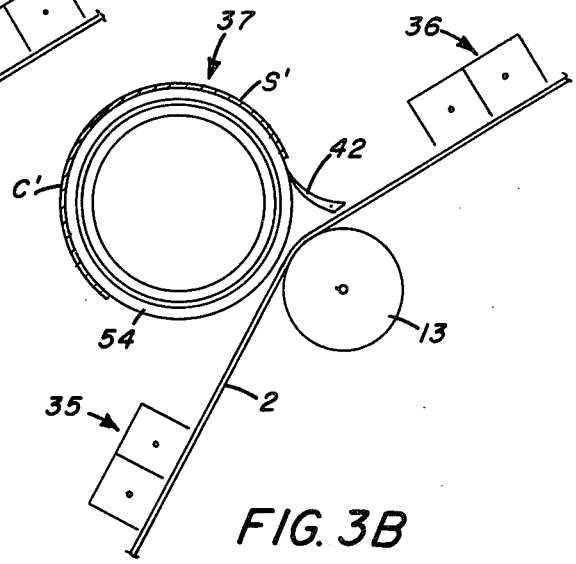

Referring to FIGS. 3A–3D there is shown in more detail the operation of drum means 37 in the duplex mode. In FIG. 3A, shell 54 is shown being rotated in a first (counterclockwise) direction to separate copy sheet S′ from transfer relation with member 2 after a first toner image has been transferred from member 2 at first transfer station 35 to a first side C′ of sheet S′. Diverter 42 has been moved to its second position out of contact with shell 54 so that copy sheet S′ can be wrapped around shell 54 without interference from diverter 42. In FIG. 3B, copy sheet S′ is shown completely wrapped around shell 54, the counterclockwise rotation of which has been halted and diverter 42 has been moved to its first position in contact with shell 54. Since the unfixed first toner image transferred to side C′ of copy sheet S′ is facing outwardly there is no disturbance of such image and thus no need for the fixing of the first image to sheet S′.

Figure 3C:
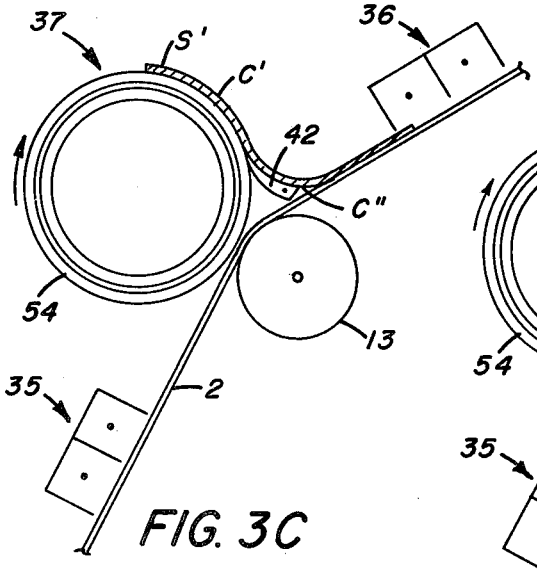

As shown in FIG. 3C, shell 54 is rotated in a second (clockwise) direction to register the second unimaged side C″ of copy sheet S′ with the second toner image on web 2 at second transfer station 36. Diverter 42 is shown in substantial contact with shell 54 to effect a guide path for sheet S′ from drum means 37 to member 2.

Figure 3D:
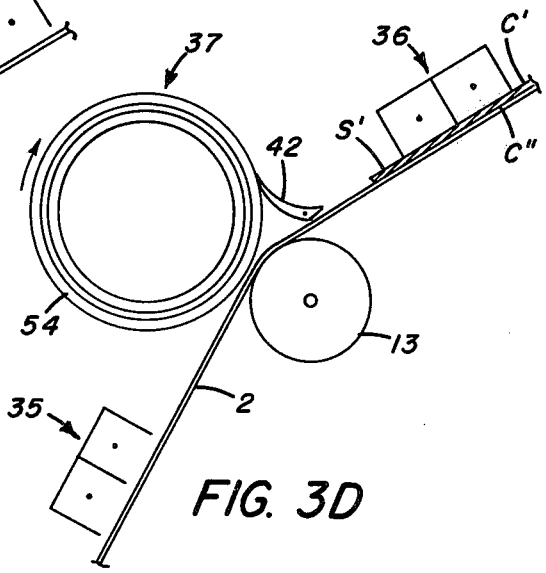

FIG. 3D shows sheet S′ after it has cleared shell 54 and diverter 42 as it passes under transfer station 36 for transfer of the second toner image to side C″ of copy sheet S′. Subsequently, diverter 42 would be moved to the position shown in FIG. 3A, the direction of shell 54 would be reversed and the sequence of FIGS. 3A–3D would be repeated with respect to the next copy sheet S′.

Figure 4:
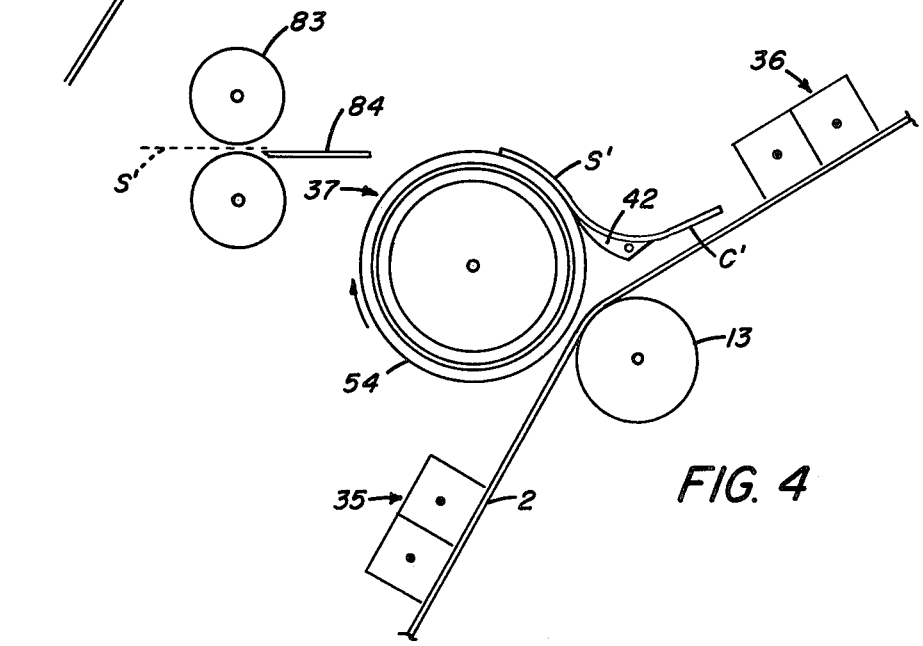
FIG. 4 is a diagrammatic sectional view of the station of FIG. 2 in the simplex mode.

Referring now to FIG. 4, there is shown duplexing-/simplexing station 4 as it is operated in the simplex mode. Copy sheets S′ are supplied by rollers 83 over guide 84 to vacuum drum means 37. Shell 54 is rotated in the second (clockwise) direction to direct a sheet S′ over diverter 42 into transfer relationship with member 2 at second transfer station 36 in registration with the simplex image which is transferred to the first side of sheet S′. After image transfer, sheet S′ is directed to output station 6.

Logic and Control Unit

Figure 5:
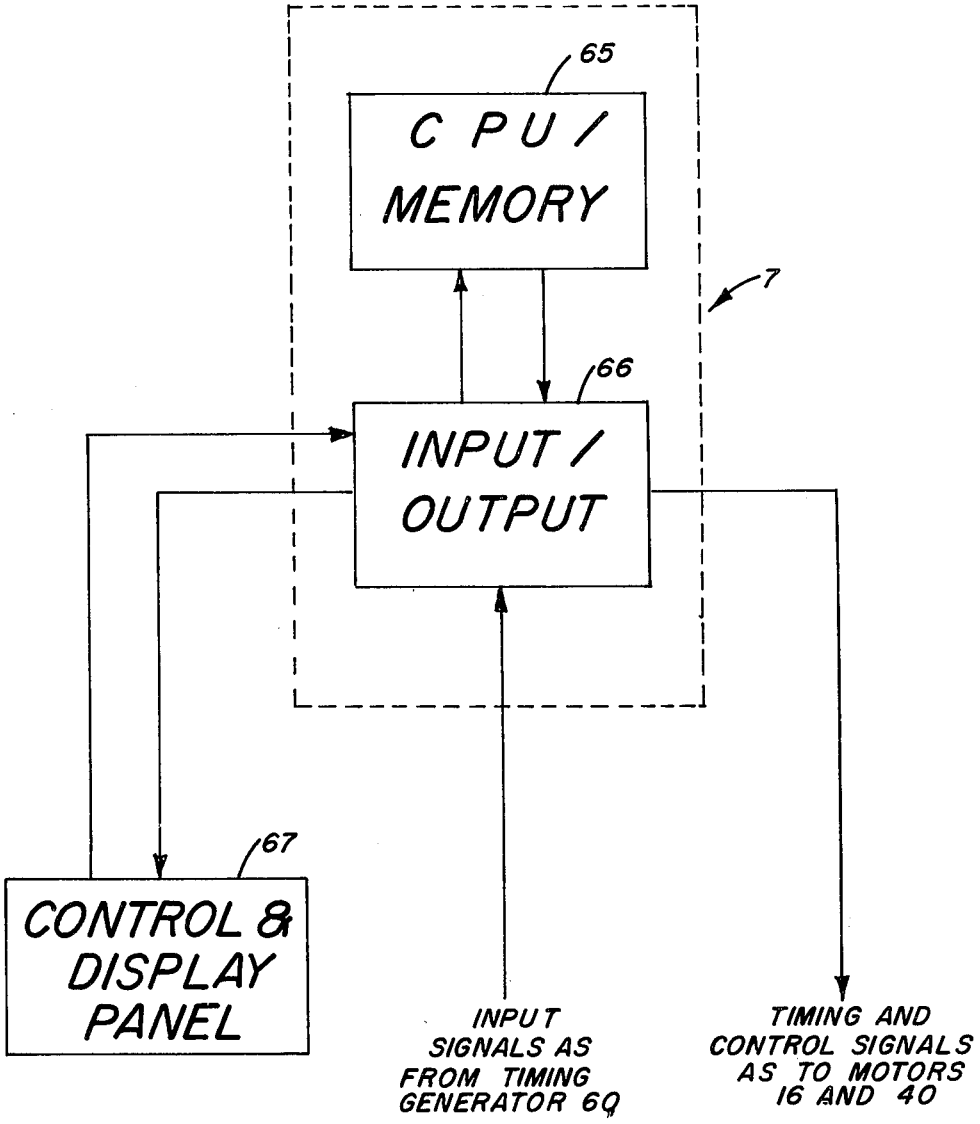
FIG. 5 is a block diagram of the control unit of FIG. 1.

As shown in FIG. 1, and more particularly in FIG. 5, operation of copier 1 and its related accessories such as feeder 25 and copy handling accessory 49 is monitored and controlled by a digital microprocessor incorporated in logic and control unit (LCU) 7. LCU 7 may include a central processing unit (CPU) and memory module 65 and an input/output module 66. Module 65 includes a central processing unit (CPU) which processes data in digital format, a program memory such as a read only memory (ROM) which stores basic logic and control subroutines and a random access memory (RAM) which is used for temporary memory and for maintaining a short term account of the flow of original documents and of copies being processed. Module 66 provides all of the control signals and data bus connections to communicate with the CPU, ROM and RAM of module 65.

A control and display panel 67 is provided on copier 1 and includes operator selectable switches and controls for such functions as number of copies desired, choice of simplex or duplex copying etc. and also includes displays to indicate information such as number of copies selected, number of copies produced, jam conditions in the copier or its accessories, etc. Input signals to LCU 7 are derived from various switches, sensors and the like which monitor copier operation, track the passage of copy sheets, etc., and from a timing generator generator 60. As disclosed in U.S. Pat. No. 3,914,047, member 2 may include a series of perforations along an edge thereof which are sensed by a sensor such as a piezoelectric or optic sensor 60. The perforations provide a means of generating timing signals which are related to the movement of web 2 and which are used to synchronize the various mechanisms of copier 1 and its accessories with the location of the images formed on web 2.

Output signals from LCU 7 control the various work stations of the copier including turning drive motor 16 on and off, initiating flash lamps 23 and 24 and controlling the direction of motor 40 to effect operation of drum assembly 37 during duplex and simplex operation.

The inventiion has been described in detail with particular reference to preferred embodiments thereof but it will be understood that variations and modifications can be effected within the spirit and scope of the invention.

What is claimed is:

1. In apparatus for producing simplex or duplex copies and including a movable image transfer member upon which unfixed, transferable images may be formed and image transfer means for transferring the transferable images from the transfer member to copy sheets, the improvement comprising:

vacuum member means located adjacent to and operable in synchronism with said transfer member for moving:

when duplex copies are being made, in a first direction to separate by vacuum attraction from the transfer member a copy sheet to one side of which a first transferable image has been transferred by said transfer means from said member, and then in a second direction following separation of the copy sheet from the transfer member to invert the copy sheet relative to the transfer member while said first image is unfixed and to bring the other side of the copy sheet into transfer relationship with a second transferable image on the transfer member at said transfer means; and when simplex copies are being made, in said second direction to bring one side of a copy sheet into transfer relationship with a first transferable image on said transferable member at said transfer means.

2. In apparatus for producing images on one or both sides of a copy sheet having first and second sides, said apparatus including a movable image transfer member, means for forming unfixed transferable images on said image transfer member and first and second image transfer means for transferring said images from said transfer member to a copy sheet, the improvement comprising, vacuum member means which is located adjacent to said image transfer member between said first and second image transfer means and which is movable in first and second opposite directions for operating in synchronism with said movable image transfer member;

in a duplex mode wherein said vacuum member means is moved in said first direction to separate by vacuum attraction from transfer relationship with said transfer member a copy sheet to a side of which a first transferable image has been transferred by said first image transfer means and in said second direction after said copy sheet has been separated from said transfer member to invert said copy sheet while said first image is unfixed to bring the second side of said copy sheet into transfer relationship with a second image on said transfer member at said second image transfer meas; and in a simplex mode wherein said vacuum member means is moved in the second direction to bring the first side of a copy sheet into transfer relationship with a first transferable image on said transfer member at said second transfer station.

3. The improvement of claim 2 including fixing means for fixing said images to said copy sheet.

4. The improvement of claim 2 including a sheet diverter located between said vacuum member means and said transfer member for guiding the copy sheet into transfer relation with said transfer member at said second image transfer means.

5. The improvement of claim 2 wherein said image transfer member includes a photoconductive member and said image forming means includes means for forming transferable toner images on said photoconductive member.

6. The improvement of claim 5 including a fixing station having a pair of heated fuser rollers for fixing the toner images transferred to copy sheets.

7. Apparatus for producing images on one or both sides of a copy sheet, comprising:

a movable image transfer member;

image forming means for forming transferable images on said image transfer member;

first and second image transfer means for transferring said images from said transfer member to a copy sheet;

supply means for supplying copy sheets having first and second sides into transfer relationship with said image transfer member;

a vacuum member which is located adjacent to said image transfer member between said first and second image transfer transfer means and which is movable in first and second opposite directions; and means operatively associated with said image forming means, said supply means and said vacuum member for synchronizing the operation thereof;

in a duplex mode to cause said image forming means to form first and second transferable images on said image transfer member, said supply means to supply a copy sheet into transfer relationship with said first image on said image transfer member at said first transfer means and said vacuum member to move in a first direction to separate said copy sheet to which said first image has been transferred to the first side thereof, out of transfer relationship with said transfer member and to move said vacuum member in a second opposite direction after said copy sheet has been separated from said transfer member to invert said copy sheet while said first image is unfixed and to bring the second side of said copy sheet into transfer relationship with the second transferable image on said transfer member at said second transfer means; and in a simplex mode to cause said image forming means to form a first transferable image on said image transfer member, said vacuum member to move in the second direction, and said supply means to supply a copy sheet into contact with said vacuum member so as to move said copy sheet into transfer relationship with the first transferable image on said transfer member at said second transfer means.

8. The apparatus of claim 7 including fixing means for fixing images to said copy sheet.

9. The apparatus of claim 7 wherein said image transfer member includes a photoconductive member, wherein said image forming means forms transferable toner images on said photoconductive member and wherein said first and second image transfer means are adapted to transfer toner images formed on said photoconductive member to a copy sheet.

10. The apparatus of claim 9 including fixing means for fixing to a copy sheet toner images transferred thereto.

11. The apparatus of claim 10 wherein said fixing means includes a pair of rollers forming a pressure nip through which said copy sheet passes.

12. The apparatus of claim 11 wherein at least one of said pair of rollers is heated.

13. The apparatus of claim 7 including a sheet diverter located between said vacuum member and said transfer member for guiding said copy sheet into transfer relation with said transfer member at said second image transfer means.

14. In a copier for producing simplex or duplex copies including a movable image transfer member upon which transferable images may be formed, first and second image transfer stations located adjacent said image transfer member and a vacuum member movable in first and second opposite directions located adjacent said image transfer member between said first and second image transfer stations, improved copy sheet handling apparatus comprising:

a supply for copy sheets;

means defining a first copy sheet path for supplying a copy sheet from said supply into image transfer relationship with said image transfer member at said first transfer station when a duplex copy is made; and means defining a second copy sheet path including said vacuum member for supplying a copy sheet from said supply into image transfer relationship with said image transfer member at said second transfer station when a simplex copy is made.

15. The improvement of claim 2 wherein said vacuum member means comprises vacuum drum means rotatable in first and second opposite directions.

16. The apparatus of claim 7 wherein said vacuum member comprises a vacuum drum which is rotatable in first and second opposite directions.

* * * * *